US006410195B1

(12) United States Patent
Tanaka et al.

(10) Patent No.: US 6,410,195 B1
(45) Date of Patent: Jun. 25, 2002

(54) ELECTROPHOTOGRAPHIC PHOTOSENSITIVE MEMBER, PROCESS CARTRIDGE, AND ELECTROPHOTOGRAPHIC APPARATUS

(75) Inventors: Takakazu Tanaka, Numazu; Yuka Nakajima, Mishima, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/633,870

(22) Filed: Aug. 7, 2000

(30) Foreign Application Priority Data

Aug. 12, 1999 (JP) ..... 11-228773

(51) Int. Cl.[7] ..... G03G 5/05

(52) U.S. Cl. ..... 430/56; 430/58.7; 430/59.6; 430/96; 399/116; 399/159

(58) Field of Search ..... 430/56, 58.05, 430/58.7, 59.6, 67, 66, 96; 399/116, 159

(56) References Cited

U.S. PATENT DOCUMENTS

| | | | | |
|---|---|---|---|---|
| 2,297,691 A | | 10/1942 | Carlson | |
| 3,779,750 A | | 12/1973 | Merrill et al. | |
| 3,837,851 A | | 9/1974 | Shattuck et al. | |
| 3,871,880 A | | 3/1975 | Montillier | |
| 4,063,947 A | * | 12/1977 | Pochan et al. | 430/58.25 |
| 4,172,933 A | * | 10/1979 | Turner | 430/56 |
| 4,618,672 A | | 10/1986 | Hashimoto | 534/658 |
| 4,743,523 A | | 5/1988 | Yamashita et al. | 430/70 |
| 4,788,119 A | | 11/1988 | Yamashita et al. | 430/77 |
| 4,851,960 A | | 7/1989 | Nakamura et al. | 361/225 |
| 5,418,098 A | | 5/1995 | Mayama et al. | 430/96 |
| 5,418,099 A | | 5/1995 | Mayama et al. | 430/66 |
| 5,485,250 A | * | 1/1996 | Kashimura et al. | 430/67 |
| 5,518,847 A | * | 5/1996 | Chen | 430/66 |
| 5,903,803 A | * | 5/1999 | Kawai et al. | 399/116 |
| 6,180,303 B1 | * | 1/2001 | Uematsu et al. | 430/59.6 |

FOREIGN PATENT DOCUMENTS

| | | | | |
|---|---|---|---|---|
| DE | 26 30 784 | | 3/1977 | |
| EP | 740216 | | 10/1996 | |
| EP | 0 964 309 A1 | | 12/1999 | |
| EP | 1001316 A1 | | 5/2000 | |
| FR | 2 330 037 | | 5/1977 | |
| JP | 56-17356 | * | 2/1981 | 430/96 |
| JP | 56-167759 | | 12/1981 | |
| JP | 57-17826 | | 1/1982 | |
| JP | 57-19576 | | 2/1982 | |
| JP | 58-40566 | | 3/1983 | |
| JP | 61-228453 | | 10/1986 | |
| JP | 61-272754 | | 12/1986 | |
| JP | 63-149668 | | 6/1988 | |
| JP | 6-51544 | | 2/1994 | |
| JP | 6-75415 | | 3/1994 | |

OTHER PUBLICATIONS

Japio Abstract of JP 56–17356, pub. Feb. 19, 1981.*

Caplus Abstract An 1981: 452675 of JP 56–17356, pub Feb. 19, 1981.*

Kadaschchuk, Et Al., "On the Application of Thermoluminescence for Probing the Energetic Disorder in Amorphous Molecular Solids", Advanced Materials for Optics and Electronics, vol. 7, No. 2, Mar. 1, 1997 (pp. 99–103).

* cited by examiner

*Primary Examiner*—Janis L. Dote
(74) *Attorney, Agent, or Firm*—Fitzpatrick, Cella, Harper & Scinto

(57) ABSTRACT

An electrophotographic photosensitive member comprising a support and a photosensitive layer provided thereon. The photosensitive layer fulfilling at least one of the following conditions (A) and (B):

(A) containing a polymerization product of a monomer having a reactive group represented by the following Formula (1):

$$—O—(—CH_2—)_n—CH=CH—R_0 \quad (1);$$

and (B) containing a copolymerization product of a monomer having a reactive group represented by the following Formula (2):

$$—O—CH=CH_2 \quad (2)$$

with a charge-transporting material having a reactive group capable of reacting with the monomer.

14 Claims, 1 Drawing Sheet

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

This invention relates to an electrophotographic photosensitive member, a process cartridge and an electrophotographic apparatus. More particularly, it relates to an electrophotographic photosensitive member containing a specific resin, a process cartridge and an electrophotographic apparatus which have such an electrophotographic photosensitive member.

2. Related Background Art

Electrophotography makes use of a photoconductive material comprised of a support coated with a substance that changes in electrical resistance in accordance with the amount of irradiation received during exposure and also has insulating properties in the dark as disclosed in U.S. Pat. No. 2,297,691. Fundamental features required in electrophotographic photosensitive members making use of such a photoconductive material are (1) that the electrophotographic photosensitive member is chargeable to a suitable potential in the dark, (2) that it may less scatter and lose the potential in the dark and (3) that it releases electric charges quickly upon irradiation by light.

As electrophotographic photosensitive members, inorganic photosensitive members, having a photosensitive layer composed chiefly of an inorganic photoconductive compound, such as zinc oxide or cadmium sulfide, have conventionally been in wide use. These fulfill the above conditions (1) to (3), but have not necessarily been satisfactory with respect to thermal stability moisture resistance, durability and productivity.

In recent years, in order to overcome disadvantages of such inorganic photosensitive members, electrophotographic photosensitive members composed chiefly of organic photoconductive compounds have been energetically studied and developed. For example, a photosensitive member having a charge transport layer containing a triallylpyrazoline, as disclosed in U.S. Pat. No. 3,837,851, and a photosensitive member comprised of a charge generation layer formed of a derivative of a perylene pigment and a charge transport layer formed of a condensate of 3-propylene with formaldehyde, as disclosed in U.S. Pat. No. 3,871,880, are known in the art.

In addition, some of the organic photoconductive compounds enable free selection of photosensitive wavelength regions of electrophotographic photosensitive members. For example, as azo pigments, Japanese Patent Application Laid-open No. 61-272754 and No. 56-167759 disclose substances showing a high sensitivity in the visible region. Also, Japanese Patent Application Laid-Open No. 57-19576 and No. 61-228453 disclose compounds having a high sensitivity up to the infrared region.

Of these materials, those showing a sensitivity in the infrared region are used in laser printers (hereinafter "LBP") and LED printers having made remarkable progress in recent years, and have become in great demand.

Electrophotographic photosensitive members making use of these organic photoconductive compounds are often used as function-separated photosensitive members having a charge generation layer and a charge transport layer formed superposingly, in order to satisfy both electrical and mechanical properties.

Meanwhile, as a matter of course, electrophotographic photosensitive members are required to have sensitivity, electrical properties and optical properties which have been adapted to the electrophotographic processes employed.

In particular, in the case of electrophotographic photosensitive members used repeatedly, the electrical and mechanical external force produced by corona or contact charging, exposure, development with toner, transfer, and surface cleaning is directly applied to the surfaces of the electrophotographic photosensitive members. Hence, they are required to have durability to such an external force.

Stated specifically, they are required to have durability to electrical deterioration caused by ozone and nitrogen oxides at the time of charging and to mechanical deterioration and electrical deterioration such that the surface is worn or scratched as a result of its friction with a cleaning member.

With regard to the electrical deterioration, there is a phenomenon in which carriers stagnate at areas irradiated by light to cause a potential difference between those areas and areas not irradiated by light. This phenomenon occurs as a photomemory.

With regard to the mechanical deterioration, the organic photosensitive members, mostly made of soft materials, have an inferior durability in mechanical deterioration different from inorganic photosensitive members. Hence, the former is especially earnestly sought to be improved in durability.

A variety of attempts have been made in order to satisfy such durability characteristics required in photosensitive members.

As resins widely used in surface layers and having good wearability and electrical properties, a polycarbonate resin having the skeleton formed of bisphenol A attracts notice, but it does not solve all the problems stated. It has the following problems:

(1) It has so poor a solubility as to show a good solubility only in some halogenated aliphatic hydrocarbons, such as dichloromethane and 1,2-dichloroethane. Moreover, since these solvents have a low boiling point, coated surfaces tend to whiten when photosensitive members are produced by the use of coating fluids prepared using such solvents. Solid-matter management of coating fluids also takes much time.

(2) It is partly soluble in solvents other than the halogenated aliphatic hydrocarbons, e.g., in tetrahydrofuran, dioxane and cyclohexanone or mixed solvents of any of these. However, the resultant solutions have poor properties with time, e.g., they gel in few days, and are not suited for the production of photosensitive members.

(3) Moreover, even if the problems (1) and (2) are solved, the polycarbonate resin having the skeleton formed of bisphenol A tends to cause solvent cracking.

(4) In addition, in the case of conventional polycarbonate resins, coating films formed of such resins have no lubricity, and hence photosensitive members tend to be scratched to cause in some cases i) faulty images under cleaning conditions so set that the electrophotographic photosensitive member may wear in a low quantity or ii) faulty cleaning or toner melt-adhesion due to premature deterioration of a cleaning blade.

The problem on the solution stability referred to in paragraphs (1) and (2) has been solved by using a polycarbonate-Z resin having a bulky cyclohexylene group as a polymer structural unit, or by copolymerization with bisphenol Z or bisphenol C.

The problem of solvent cracking can be solved by using a silicon-modified polycarbonate or an ether-modified polycarbonate as disclosed in Japanese Patent Application Laid-Open No. 6-51544 and No. 6-75415. However, compared with conventional polycarbonate resins, these modified polycarbonates take a structure that imparts a flexibility to internal stress in a polymer as a countermeasure to solvent cracking, and hence have the disadvantage that the polymer itself has a low mechanical strength.

In addition, recently, a contact charging system is becoming prevalent in which a voltage is directly applied to a charging member to apply electric charges to an electrophotographic photosensitive member as disclosed in Japanese Patent Application Laid-Open No. 57-17826 and No. 58-40566. This is a method in which a roller type charging member constituted of a conductive rubber or the like is brought into direct contact with the electrophotographic photosensitive member to which electric charges are applied. This method has advantages such that ozone is generated in a greatly smaller quantity than Scorotron or the like and, while in Scorotron about 80% of the electric currents flowing in a charging assembly are wasted since they flow to a shield, the contact charging member is free from such waste and is very economical.

However, the contact charging has the disadvantage that its charging stability is very poor because of discharging due to Paschen's law. As a countermeasure to this disadvantage, what is called an AD/DC charging system is devised in which an alternating-current voltage is superimposed on a direct-current voltage (Japanese Patent Application Laid-Open No. 63-149668).

This charging system has brought about an improvement in stability at the time of charging, but has anew caused the disadvantage that the electrophotographic photosensitive member is abraded in a large quantity because the discharge quantity on the surface of the electrophotographic photosensitive member is large. Thus, it has come to be required that not only mechanical strength, but also electrical strength is ensured.

SUMMARY OF THE INVENTION

An object of the present invention is to provide an electrophotographic photosensitive member that has solved the problems caused when conventional polycarbonate resins are used in surface layers, has a high mechanical strength while having solvent cracking resistance and also resists any electrical deterioration due to a contact charging member, and a process cartridge and an electrophotographic apparatus that have such an electrophotographic photosensitive member.

The present invention provides an electrophotographic photosensitive member comprising a support and a photosensitive layer provided thereon;

a photosensitive layer fulfilling at least one condition of the following conditions (A) and (B):

(A) containing a polymerization product of a monomer having a reactive group represented by the following Formula (1):

$$—O—(—CH_2—)_n—CH=CH—R_0 \quad (1)$$

wherein $R_0$ represents a hydrogen atom or a methyl group, and n represents O or 1, provided that Ro represents a methyl group when n is O; and (B) containing a copolymerization product of a monomer having a reactive group represented by the following Formula (2):

$$—O—CH=CH_2 \quad (2)$$

with a charge-transporting material having a reactive group capable of reacting with the monomer.

The present invention also provides a process cartridge and an electrophotographic apparatus which have the electrophotographic photosensitive member described above.

DESCRIPTION OF THE PREFERRED EMBODIMENTS

Figure 1:
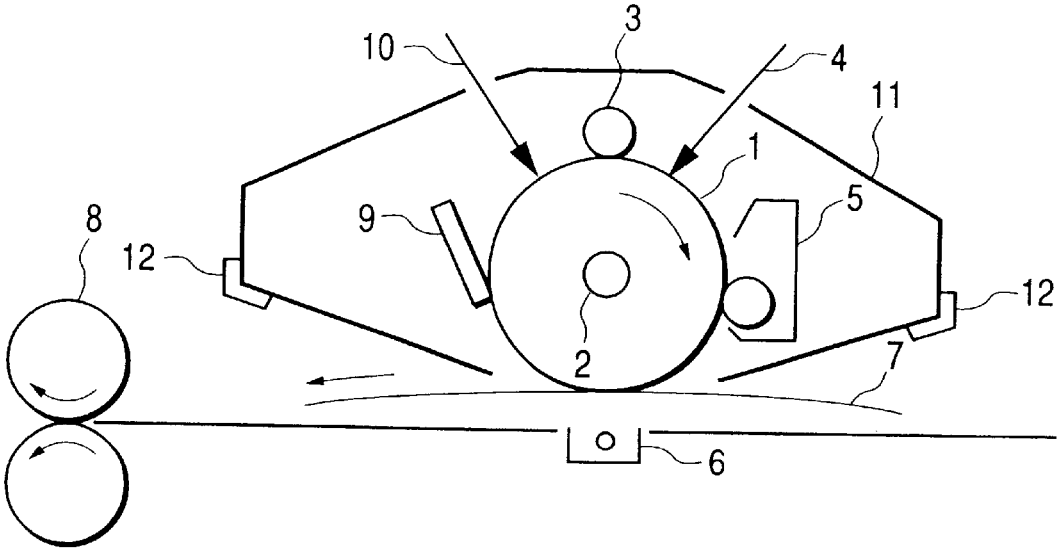
FIG. 1 is a schematic illustration of an example of the construction of an electrophotographic apparatus having a process cartridge which has the electrophotographic photosensitive member of the present invention.

The electrophotographic photosensitive member of the present invention comprises a support and provided thereon a photosensitive layer which fulfills at least one condition selected from the group consisting of the following conditions (A) and (B).

(A) To contain a polymerization product of a monomer having a reactive group represented by the following Formula (1):

$$—O—(—CH_2—)_n—CH=CH—R_0 \quad (1)$$

wherein $R_0$ represents a hydrogen atom or a methyl group, and n represents 0 or 1, provided that $R_0$ represents a methyl group when n is 0.

(B) To contain a copolymerization product of a monomer having a reactive group represented by the following Formula (2):

$$—O—CH=CH_2 \quad (2)$$

with a charge-transporting material having a reactive group capable of reacting with the monomer.

In the case where the photosensitive layer fulfills the condition (A), the photosensitive layer may contain the same charge-transporting material as that in the condition (B) but having a reactive group capable of reacting with the monomer specified in the condition (A).

In the present invention, the above polymerization product or copolymerization product is used as a binder resin of the photosensitive layer. In other words, the photosensitive layer is formed of a binder resin which may contain the charge-transporting material (hereinafter often "binder resin of the present invention") and contains another charge-transporting material originally added as such for a photosensitive layer or charge transport layer.

There are no particular limitations on structures other than the above reactive group in the monomer having a reactive group of Formula (1) or (2). Since the polymerization product or copolymerization product is used as a binder resin of the photosensitive layer, the monomer itself does not have any charge-transporting properties.

In order to improve the mechanical strength of the polymerization product or copolymerization product, the monomer may preferably be a polyfunctional monomer having at least two reactive groups of Formula (1) or (2).

The monomer having a reactive group of Formula (1) or (2) has so high a reactivity that a high sensitivity can be attained when used in a system in which a charge-transporting material having an aromatic amine structure is mixed. Hence, the monomer may preferably have an aromatic-ring structure or a fumarate structure in the monomer structure. Also, in order for the monomer to be compatible with the charge-transporting material and to be advantageous to electrophotographic performance, it may particularly preferably have an aromatic-ring structure in the monomer structure.

The charge-transporting material may also have a solubility of 50 mg/g or above, in the monomer having a reactive group of Formula (1) or (2). This is preferable because a uniform film can be formed with ease.

From the viewpoint of improving mechanical strength, the charge-transporting material to be mixed may preferably have a reactive group capable of reacting with the monomer having a reactive group of Formula (1). Stated specifically, it may preferably have a reactive group selected from the following structures.

In the case where the monomer having a reactive group of Formula (1) is not contained, however, the monomer having a reactive group represented by Formula (2) and the charge-transporting material having a reactive group capable of reacting with the monomer must be used in order to attain mechanical strength.

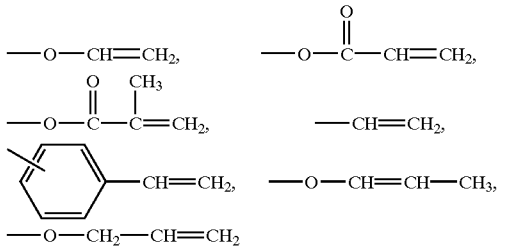

The monomer may also have a molecular weight not more than 2,000, and particularly not more than 1,000. This is preferable because a dense film can be formed and a high strength can be attained with ease.

There are no particular limitations on the basic structure of the charge-transporting material having the above reactive group. Preferred are those having any of the structures represented by the following structural formulas (3) to (5). Of these, those of formulas (3) and (4) belong to a charge-transporting material having an aromatic amine structure.

(3)

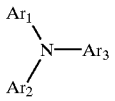

wherein $Ar_1$, $Ar_2$ and $Ar_3$ each represent an aromatic-ring group or heterocyclic group which may be substituted, and at least one of the groups represented by $Ar_1$, $Ar_2$ and $Ar_3$ has a reactive group capable of reacting with the reactive group represented by Formula (1) or (2).

(4)

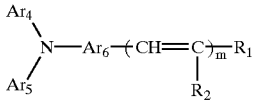

wherein $Ar_4$ and $Ar_5$ each represent an aromatic-ring group which may be substituted; $R_6$ represents a divalent aromatic-ring group or divalent heterocyclic group which may be substituted; $R_1$ represents an alkyl group or aromatic-ring group which may be substituted; $R_2$ represents a hydrogen atom or an alkyl group or aromatic-ring group which may be substituted; m is 1 or 2 and $R_1$ and $R_2$ may combine to form a ring; and at least one of the groups represented by $Ar_4$, $Ar_5$, $R_1$ and $R_2$ has a reactive group capable of reacting with the reactive group represented by Formula (1) or (2).

(5)

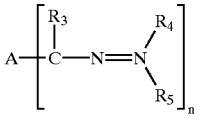

wherein $R_3$ represents a hydrogen atom or an alkyl group which may be substituted; $R_4$ and $R_5$ each represent an alkyl group, aralkyl group or aromatic-ring group which may be substituted; p is 1 or 2; A represents an aromatic-ring group or heterocyclic ring which may be substituted, or a —CH=C($R_6$)$R_7$ group where $R_6$ and $R_7$ each represent a hydrogen atom, an aromatic-ring group or a heterocyclic ring group, provided that $R_6$ and $R_7$ are not hydrogen atoms at the same time; and at least one of the groups represented by $R_3$ to $R_5$ and A has a reactive group capable of reacting with the reactive group represented by Formula (1) or (2).

In the foregoing, the alkyl group may include groups such as methyl, ethyl and propyl; the aromatic-ring group, groups such as phenyl, naphthyl and anthryl; the aralkyl group, groups such as benzyl and phenethyl; and the heterocyclic group, groups such as pyridyl, thionyl, thiazoyl, carbazoyl, benzoimidazolyl and benzothiazolyl.

Exemplary monomers used in the present invention are shown in Table 1 below. Examples are by no means limited to these.

Of the monomers listed in Table 1, in view of the compatibility with the charge-transporting material, exemplary monomers 13, 15, 18, 20, 25, 38, 40 and 42 are preferred and exemplary monomers 13, 15, 18, 38, 40 and 42 are particularly preferred.

The electrophotographic photosensitive member of the present invention has especially superior solvent cracking resistance, mechanical strength and dielectric strength in AC charging at the same time, and has a good electrophotographic performance.

The polymerization product or copolymerization product used in the present invention as a binder resin has the reactive groups represented by Formula (1) or (2). Accordingly, it is presumed that a condensation reaction proceeds by heating at the time of film formation and curing is effected to increase the binding density so that the whole polymeric coating film is improved in its durability while becoming resistant to solvent cracking.

In the electrophotographic photosensitive member of the present invention, the monomer having a reactive group represented by Formula (1) or (2), which constitutes the binder resin used in the present invention, may be comprised of a single monomer or of two or more kinds of monomers.

For the purpose of improving the film uniformity, any existing resin and oligomer may also optionally be contained as long as the remarkable effect of the present invention can be obtained.

Besides, an initiator such as a photo-cationic polymerization initiator, a lubricant such as fine fluorine-containing-resin particles, an antioxidant, and an inorganic filler such as a metal oxide may optionally be contained.

The electrophotographic photosensitive member of the present invention is constructed as described below.

In the electrophotographic photosensitive member of the present invention, the photosensitive layer provided on the support may be either of a single-layer type in which a charge-transporting material and a charge-generating material are contained in the same layer and a stacked type which is separated functionally into a charge transport layer containing a charge-transporting material and a charge generation layer containing a charge-generating material. The stacked type is preferred in view of electrophotographic performance. The polymerization product or copolymerization product used in the present invention has so good a durability that it may preferably be contained in the surface layer of the electrophotographic photosensitive member. It may preferably be further contained in the charge transport layer.

The support used may be any of those having a conductivity, and may include supports made of a metal such as aluminum or stainless steel, or a metal, paper or plastic provided with a conductive layer. The support may be in the shape of, e.g., a sheet or a drum.

In the case of LBPs where images are inputted by means of laser light, a conductive layer may be provided in order to prevent interference fringes from being caused by scattering of light or to cover any scratches on the support. To form this layer, a conductive powder such as carbon black or metal particles may be dispersed in the binder resin. Such a conductive layer may preferably have a layer thickness of from 5 to 40 $\mu$m, and more preferably from 10 to 30 $\mu$m.

On that layer, an intermediate layer having the function of adhesion is provided. Materials for the intermediate layer may include polyamide, polyvinyl alcohol, polyethylene oxide, ethyl cellulose, casein, polyurethane and polyetherurethane. Any of these are dissolved in a suitable solvent and the resultant solution may be applied. The intermediate layer may preferably have a layer thickness of from 0.05 to 5 $\mu$m, and more preferably from 0.3 to 1 $\mu$m.

On the intermediate layer, the charge generation layer is formed. The charge-generating material used in the charge generation layer may include dyes of selenium-tellurium, pyrylium and thiapyrylium types, and pigments of phthalocyanine, anthanthrone, dibenzopyrenequinone, trisazo, cyanine, disazo, monoazo, indigo, quinacridone and asymmetric quinocyanine types.

In the case of the functionally separated type photosensitive layer, the charge generation layer is formed by dispersing the charge-generating material together with a binder resin (preferably in a 0.3- to 4-fold amount by weight) and a solvent, by a means such as a homogenizer, a sand mill, an attritor, a roll mill or a liquid impact type high-speed dispersion machine, and coating the resultant dispersion, followed by drying. The charge generation layer may preferably have a layer thickness of 5 $\mu$m or smaller, and more preferably from 0.1 to 2 $\mu$m.

The charge transport layer is formed by coating a coating fluid prepared by dissolving chiefly a charge-transporting material and the binder resin of the present invention in a solvent, followed by drying. The charge-transporting material used may include triarylamine compounds, hydrazone compounds, stilbene compounds, pyrazoline compounds, oxazole compounds, triallylmethane compounds and thiazole compounds.

Any of these compounds are applied in combination with the binder resin (preferably in a 0.3- to 4-fold amount by weight), followed by drying to form the charge transport layer. The charge transport layer may preferably have a layer thickness of from 5 to 40 $\mu$m, and more preferably from 15 to 30 $\mu$m.

In the case of the single-layer type photosensitive layer, it contains the charge-generating material, the charge-transporting material and the binder resin of the present invention which are as described above. It may preferably have a layer thickness of from 10 to 50 $\mu$m, and more preferably from 20 to 40 $\mu$m.

FIG. 1 schematically illustrates the construction of an electrophotographic apparatus having a process cartridge which has the electrophotographic photosensitive member of the present invention.

In FIG. 1, reference numeral 1 denotes a drum type electrophotographic photosensitive member of the present invention, which is rotatively driven around an axis 2 in the direction of an arrow at a stated peripheral speed. The photosensitive member 1 is uniformly electrostatically charged on its periphery to a positive or negative charge, and is given potential through a primary charging means 3. The photosensitive member thus charged is then exposed to light 4 emitted from an exposure means (not shown) for slit exposure or laser beam scanning exposure. In this way, electrostatic latent images are successively formed on the periphery of the photosensitive member 1.

The electrostatic latent images thus formed are subsequently developed with toner by the operation of a developing means 5. The resulting toner-developed images are then successively transferred by the operation of a transfer means 6 onto the surface of a transfer medium 7 fed from a paper feed section (not shown) to the part between the photosensitive member 1 and the transfer means 6 while synchronizing with the rotation of the photosensitive member 1.

The transfer medium 7 on which the images have been transferred is separated from the surface of the photosensitive member, is led to an image fixing means 8, where the images are fixed, and is then printed out of the apparatus as a a copy.

The surface of the photosensitive member 1 from which images have been transferred is subjected to removal of the toner remaining after the transfer, through a cleaning means 9. Thus the photosensitive member is cleaned on its surface, further subjected to charge elimination by pre-exposure light 10 emitted from a pre-exposure means (not shown), and then repeatedly used for the formation of images. When the primary charging means 3 is a contact charging means making use of a charging roller, the pre-exposure is not necessarily required.

Figure 2:
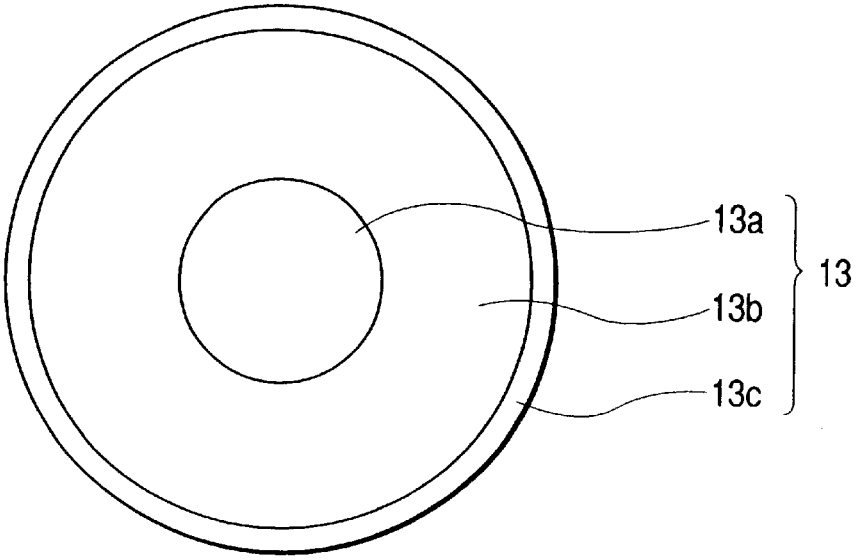
FIG. 2 shows an example of layer configuration of a roller type charging member used in the present invention.

The charging member of the contact charging means may have any form of a roller, a brush, a belt and a blade. It may preferably be used in the shape of a roller. FIG. 2 shows an example of layer configuration of a roller type charging member 13 used in the present invention.

In the contact charging system, the charging member 13 must have an appropriate elasticity so that a uniform state of contact can be ensured between the charging member 13 and the photosensitive member surface. For this end, the charging member 13 may preferably have a conductive support 13*a* made of stainless steel or the like, to which a voltage is applied, and has provided on its periphery a conductive elastic layer 13*b* containing rubber or foams and a conductive coating layer 13*c* optionally further provided on the conductive elastic layer 13*b* in order to improve wearability and prevent contamination of the photosensitive member surface.

In the present invention, the apparatus may be constituted of a combination of plural components integrally joined as a process cartridge from among the constituents such as the above electrophotographic photosensitive member 1, primary charging means 3, developing means 5 and cleaning means 9 so that the process cartridge is detachably mountable to the body of the electrophotographic apparatus such as a copying machine or a laser beam printer. For example, at least one of the primary charging means 3, the developing means 5 and the cleaning means 9 may be integrally supported in a cartridge together with the photosensitive member 1 to form a process cartridge 11 that is detachably mountable to the body of the apparatus through a guide means such as a rail 12 provided in the body of the apparatus.

In the case where the electrophotographic apparatus is a copying machine or a printer, the exposure light 4 is light reflected from, or transmitted through, an original, or light irradiated by the scanning of a laser beam, the driving of an LED array or the driving of a liquid crystal shutter array according to signals obtained by reading an original through a sensor and converting the information into signals.

The electrophotographic photosensitive member of the present invention may be not only applied to electrophotographic copying machines, but also widely used in the fields where electrophotography is applied, e.g., in laser beam printers, CRT printers, LED printers, liquid-crystal printers and laser beam engravers.

EXAMPLE

The present invention will be described below in greater detail by giving the following examples. In the following examples, "part(s)" refers to "part(s) by weight".

Example 1

Using an aluminum cylinder 30 mm in diameter and 254 mm long as a support, a coating fluid containing the following materials was applied onto the support by dip coating, followed by heat-curing at 140° C. for 30 minutes to form a conductive layer with a layer thickness of 18 μm.

| | |
|---|---|
| Conductive pigment: $SnO_2$-coated barium sulfate | 10 parts |
| Resistance-regulating pigment: titanium oxide | 2 parts |
| Binder resin: phenolic resin | 6 parts |
| Leveling material: silicone oil | 0.001 part |
| Solvent: methanol/methoxypropanol 0.2/0.8 | 20 parts |

Next, the conductive layer was coated by dip coating with a solution prepared by dissolving 3 parts of N-methoxymethylated nylon and 3 parts of copolymer nylon in a mixed solvent of 65 parts of methanol and 30 parts of n-butanol, forming an intermediate layer with a layer thickness of 0.7 μm.

Next, 4 parts of oxytitanium phthalocyanine (TiOPc) having strong peaks at Bragg's angles (2θ±0.2°) of 9.0°, 14.2°, 23.9° and 27.1° in CuKα-characteristic X-ray diffraction, 2 parts of polyvinyl butyral (trade name: S-LEC MB2; available from Sekisui Chemical Co., Ltd.) and 60 parts of cyclohexanone were dispersed for 4 hours by means of a sand mill making use of glass beads of 1 mm diameter. Thereafter, 100 parts of ethyl acetate was added to prepare a charge generation layer coating dispersion. This dispersion was applied onto the intermediate layer by dip coating to form a charge generation layer with a layer thickness of 0.3 μm.

Next, 9 parts of an amine compound having the following structural formula:

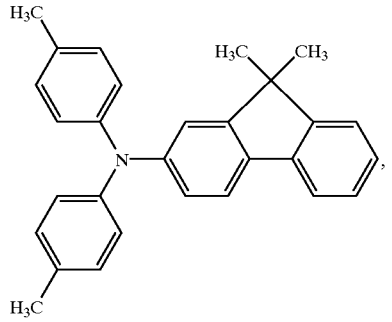

1 part of a styryl compound having the following structural formula:

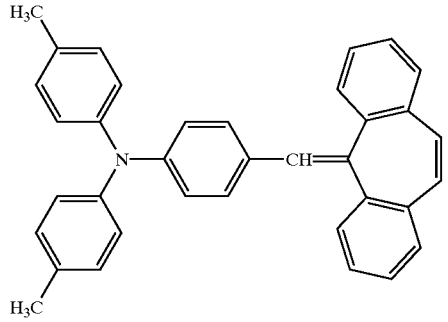

and 12 parts of a monomer of the exemplary monomer No. 1 shown in Table 1 above were dissolved in a mixed solvent of 60 parts of monochlorobenzene and 40 parts of dichloromethane.

This coating fluid was applied onto the charge generation layer by dip coating, followed by drying at 120° C. for 2 hours to form a charge transport layer with a layer thickness of 22 μm. Thus, an electrophotographic photosensitive member was produced.

Next, an evaluation was made in the following way.

A laser beam printer LASER JET 4000 (process speed 94.2 mm/s), manufactured by Hewlett Packard Co., was so remodeled as to make the primary charging peak-to-peak voltage 20% higher, and used as an apparatus. The electrophotographic photosensitive member produced was set in this apparatus to make a paper feed running test (or endurance test) in a high temperature and high humidity (H/H) environment of 28° C./90% RH. The test was carried out in an intermittent mode of stopping once for each printing on one sheet.

When toner was used up, it was replenished to make the running test until any problem appeared on images.

The electrophotographic photosensitive member was also abraded for 20 minutes according to JIS K7204, using a Taber abrader making use of an abrasive tape, and volume loss after abrasion was measured.

The electrophotographic photosensitive member was further exposed, at some part, to light of a white fluorescent lamp under 2,500 lx for 15 minutes. After being left for 5 minutes, light-area potential was measured, and the difference from light-area potential before exposure to the light was regarded as the value of photomemory.

The photosensitive member was further left for 48 hours with finger grease adhering onto its surface, and the presence or absence of solvent cracking was observed by microscopic observation at 400 magnifications, evaluating solvent cracking resistance. Results obtained are shown in Table 3. In the table, a photosensitive member having caused no solvent cracking is shown as "A"; and one having caused it, as "C".

In 1 g of the monomer, 25 mg, 50 mg or 100 mg of the charge-transporting material used was added and dissolved with stirring at room temperature to examine its solubility by visual observation. The results obtained are shown in Table 2. In the table, a case where it completely dissolved is shown as "A"; and a case where it did not completely dissolved is shown as "C".

Examples 2 to 15

Electrophotographic photosensitive members were produced in the same manner as in Example 1 except that monomers constituted as shown in Examples 2 to 15 in Table 2 were used in the binder resin of the charge transport layer. Evaluation was made similarly. Results obtained are shown in Table 3.

Examples 16 to 21

Using an aluminum cylinder 30 mm in diameter and 254 mm long as a support, a conductive layer and an intermediate layer were formed thereon in the same manner as in Example 1.

4 parts of oxytitanium phthalocyanine having strong peaks at Bragg's angles (2θ±0.2°) of 7.4° and 28.2° in CuKα-characteristic X-ray diffraction, 2 parts of polyvinyl butyral (trade name: S-LEC BX-1; available from Sekisui Chemical Co., Ltd.) and 80 parts of cyclohexanone were dispersed for 4 hours by means of a sand mill making use of glass beads of 1 mm diameter. Thereafter, 80 parts of ethyl acetate were added to prepare a charge-generation-layer coating dispersion. This dispersion was applied onto the intermediate layer by dip coating to form a charge generation layer with a layer thickness of 0.2 μm.

Charge transport layer coating fluids were further prepared in the same manner as in Examples 7, 8, 10, 11, 12 and 15 except that the charge-transporting materials used in Examples 7, 8, 10, 11, 12 and 15 were replaced with charge-transporting materials shown in Table 4. Each coating fluid was applied onto the charge generation layer by dip coating, followed by drying at 150° C. for 1 hour to form a charge transport layer with a layer thickness of 23 μm.

The photosensitive members thus produced were evaluated in the same manner as in Example 1. Results obtained are shown in Table 7.

Examples 22 to 27

Electrophotographic photosensitive members were produced in the same manner as in Examples 16 to 21, respectively, except that the monomers for charge transport layers as used in Examples 16 to 21 were replaced with monomers shown in Table 5. An evaluation was made similarly. Results obtained are shown in Table 7.

Examples 28 to 33

Electrophotographic photosensitive members were produced in the same manner as in Examples 16 to 21, respectively, except that the monomers for charge transport layers as used in Examples 16 to 21 were replaced with monomers shown in Table 6. An evaluation was made similarly. Results obtained are shown in Table 7.

Comparative Examples 1 & 2

Electrophotographic photosensitive members were produced in the same manner as in Example 1 except that the monomers for charge transport layers as used in Example 1 were replaced with polymers shown in Table 8. An evaluation was made similarly. Results obtained are shown in Table 10.

Comparative Examples 3 to 5

Electrophotographic photosensitive members were produced in the same manner as in Example 5 except that the monomers for charge transport layers as used in Example 5 were replaced with monomers shown in Table 9. An evaluation was made similarly. Results obtained are shown in Table 10.

As can be seen from the above results, the electrophotographic photosensitive member of the present invention exhibits such remarkable advantages that it has a superior solvent cracking resistance without damaging its mechanical strength, and also has a high mechanical strength, has a good dielectric strength to the discharging caused by contact charging, and can be produced with ease and is suited for the contact charging. The process cartridge and electrophotographic apparatus that have this electrophotographic photosensitive member have also been found to exhibit the like advantages.

TABLE 1

(1) $CH_3CH{=}CHOCH_2CH_2OCH_2CH_2OCH{=}CHCH_3$ (2) $CH_3CH{=}CHOCH_2CH_2OCH_2CH_2OCH_2CH_2OCH{=}CHCH_3$ (3) $CH_3CH{=}CHOCH_2CH_2O(CH_2)_4OCH_2CH_2OCH{=}CHCH_3$ (4)

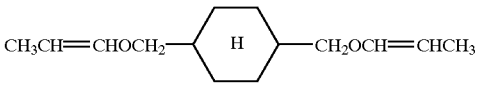

(5)

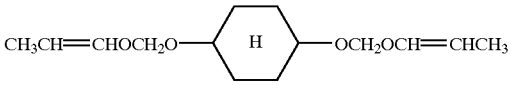

(6)

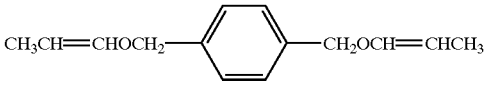

TABLE 1-continued
(7)
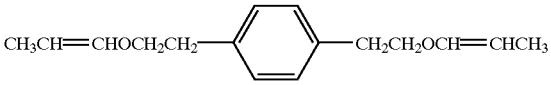
(8)
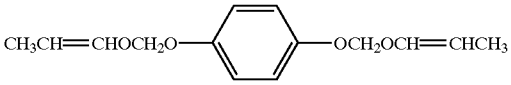
(9)
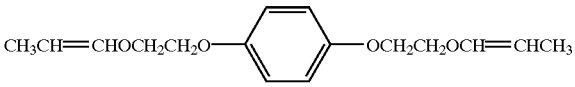
(10)
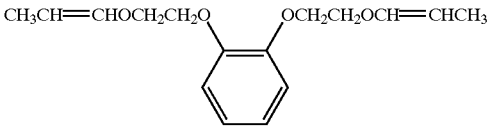
(11)
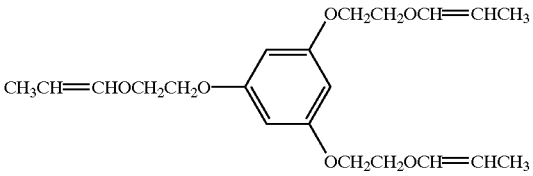
(12)
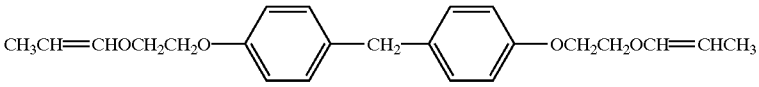
(13)
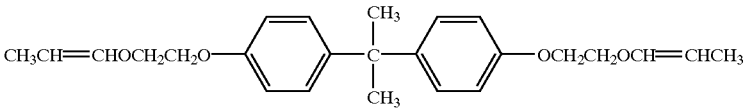
(14)
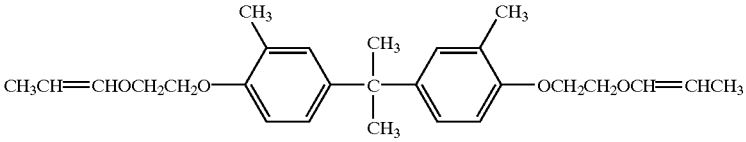
(15)
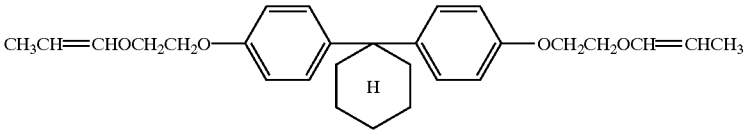
(16)
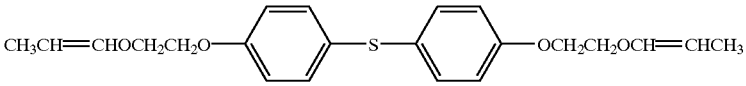
(17)
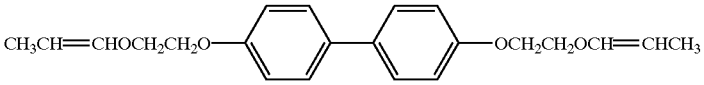
(18)
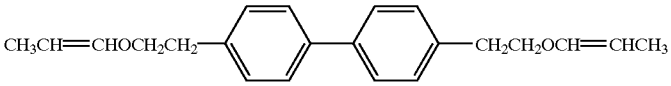

TABLE 1-continued (19)

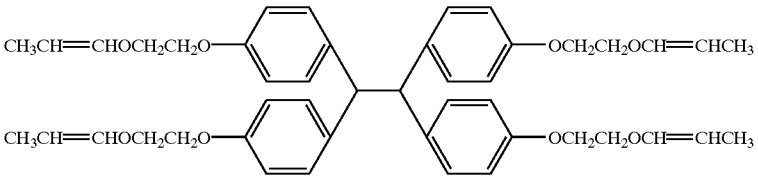

(20)

$CH_3-CH=CHOCH_2CH_2O\overset{O}{\overset{\|}{C}}CH=CH\overset{O}{\overset{\|}{C}}OCH_2CH_2OCH=CH-CH_3$ (21)

$CH_3-CH=CHOCH_2\underset{CH_3}{\underset{|}{CH}}O\overset{O}{\overset{\|}{C}}CH=CH\overset{O}{\overset{\|}{C}}O\underset{CH_3}{\underset{|}{CH}}CH_2OCH=CH-CH_3$ (22)

$CH_3CH=CHOCH_2CH_2CH_2O\overset{O}{\overset{\|}{C}}CH=CH\overset{O}{\overset{\|}{C}}OCH_2CH_2CH_2OCH=CHCH_3$ (23)

$CH_3CH=CHOCH_2CH_2(CH_2)_2O\overset{O}{\overset{\|}{C}}CH=CH\overset{O}{\overset{\|}{C}}OCH_2(CH_2)_2CH_2OCH=CHCH_3$ (24)

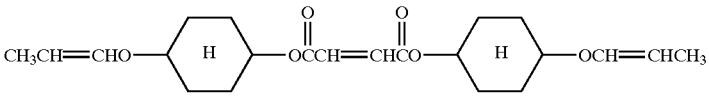

(25)

$CH_3CH=CHOCH_2CH_2O\overset{O}{\overset{\|}{C}}CH_2-\underset{CH_2}{\underset{\|}{C}}\overset{O}{\overset{\|}{C}}OCH_2CH_2OCH=CHCH_3$ (26)

$$\begin{array}{l} \quad CH_3CH=CHOCH_2CH_2OCH_2 \\ CH_3CH=CHOCH_2CH_2OCH_2-\underset{|}{C}CH_2OCH_2OCH=CHCH_3 \\ \quad CH_3CH=CHOCH_2CH_2OCH_2 \end{array}$$

(27)

$$\begin{array}{l} \quad CH_3CH=CHOCH_2CH_2OCH_2 \\ CH_3CH=CHOCH_2CH_2OCH_2-\underset{|}{C}CH_2CH_3 \\ \quad CH_3CH=CHOCH_2CH_2OCH_2 \end{array}$$

(28)

$CH_2=CHCH_2OCH_2CH_2O\overset{O}{\overset{\|}{C}}CH=CH\overset{O}{\overset{\|}{C}}OCH_2CH_2OCH_2CH=CH_2$ (29)

$CH_2=CHCH_2OCH_2\underset{CH_3}{\underset{|}{CH}}O\overset{O}{\overset{\|}{C}}CH=CH\overset{O}{\overset{\|}{C}}O\underset{CH_3}{\underset{|}{CH}}CH_2OCH_2CH=CH_2$ (30)

$CH_2=CHCH_2OCH_2CH_2CH_2O\overset{O}{\overset{\|}{C}}CH=CH\overset{O}{\overset{\|}{C}}OCH_2CH_2CH_2OCH_2CH=CH_2$ (31)

$CH_2=CHCH_2OCH_2(CH_2)_2CH_2O\overset{O}{\overset{\|}{C}}CH=CH\overset{O}{\overset{\|}{C}}OCH_2(CH_2)_2CH_2OCH_2CH=CH_2$ (32)

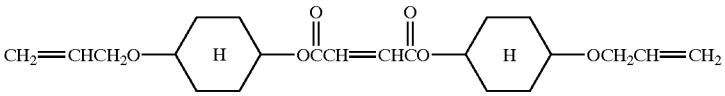

TABLE 1-continued
(33)
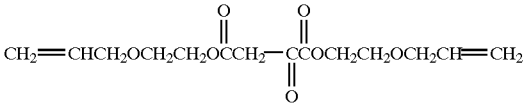
(34)
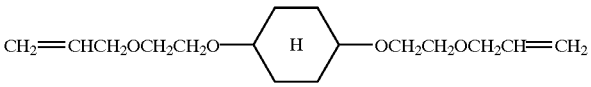
(35)
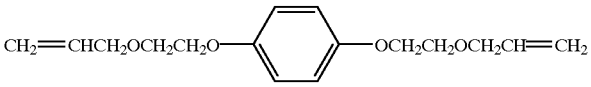
(36)
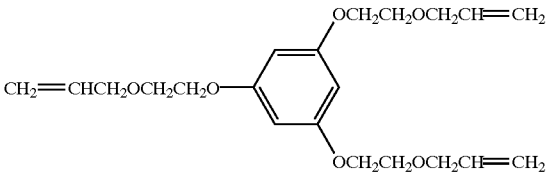
(37)
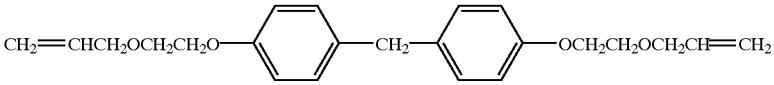
(38)
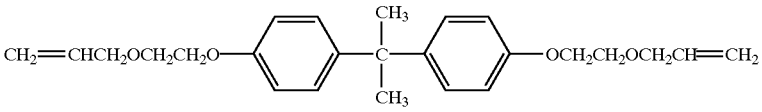
(39)
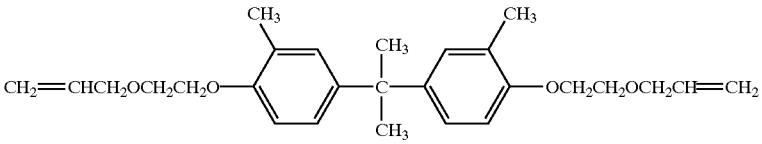
(40)
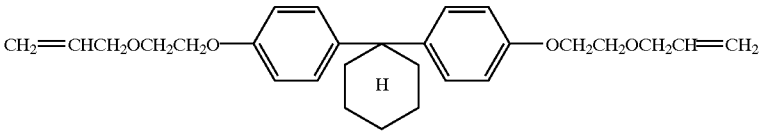
(41)
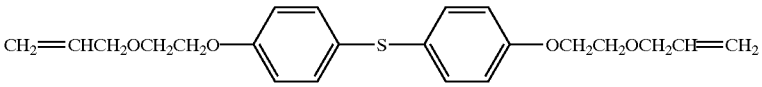
(42)
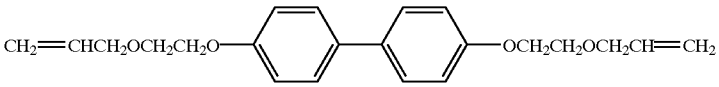
(43) $CH_2{=}CHOCH_2CH_2OCH_2CH_2OCH{=}CH_2$
(44) $CH_2{=}CHOCH_2CH_2OCH_2CH_2OCH_2CH_2OCH{=}CH_2$
(45) $CH_2{=}CHOCH_2CH_2O(CH_2)_4OCH_2CH_2OCH{=}CH_2$
(46)
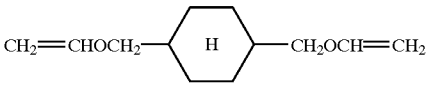
(47)
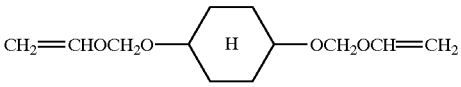

TABLE 1-continued
(48)
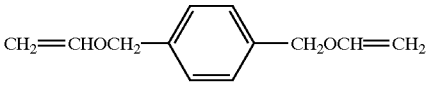
(49)
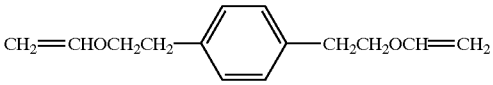
(50)
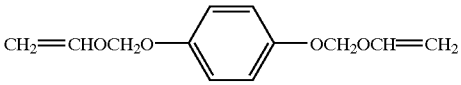
(51)
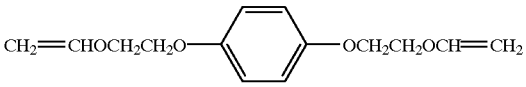
(52)
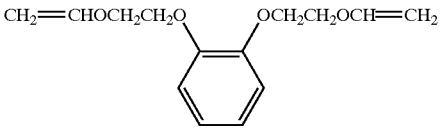
(53)
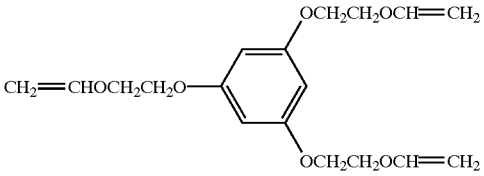
(54)
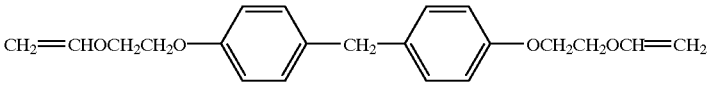
(55)
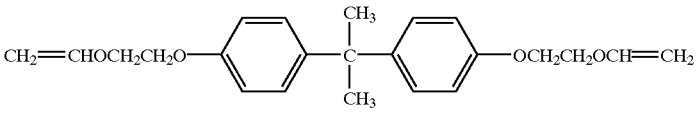
(56)
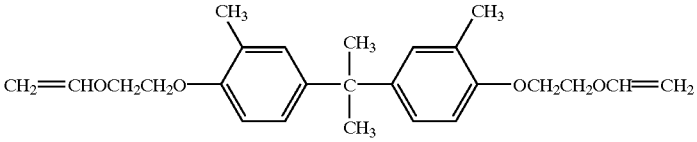
(57)
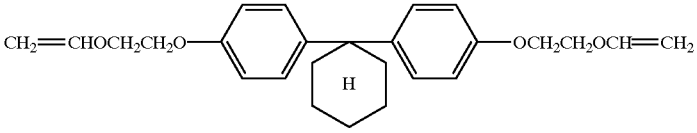
(58)
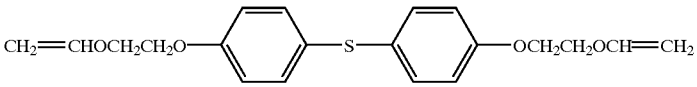
(59)
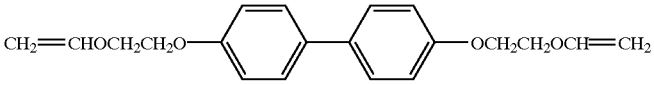
(60)
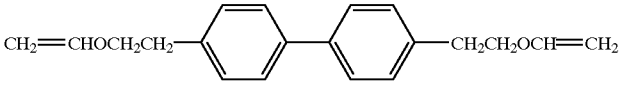

TABLE 1-continued (61)

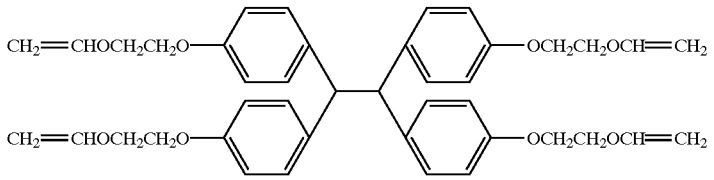

TABLE 2

| | Monomer constitution | | Blend | Solubility (mg/g) | | |
|---|---|---|---|---|---|---|
| Example: | Constituent monomer 1 | Constituent monomer 2 | ratio | 25 mg | 50 mg | 100 mg |
| 1 | Exemplary monomer 6 | — | 100/0 | A | C | C |
| 2 | Exemplary monomer 6 | Exemplary monomer 11 | 30/70 | A | C | C |
| 3 | Exemplary monomer 8 | Exemplary monomer 11 | 30/70 | A | A | C |
| 4 | Exemplary monomer 13 | — | 100/0 | A | A | A |
| 5 | Exemplary monomer 14 | — | 100/0 | A | A | A |
| 6 | Exemplary monomer 14 | Exemplary monomer 11 | 40/60 | A | A | C |
| 7 | Exemplary monomer 14 | Exemplary monomer 19 | 70/30 | A | A | A |
| 8 | Exemplary monomer 15 | — | 100/0 | A | A | A |
| 9 | Exemplary monomer 16 | Exemplary monomer 14 | 20/80 | A | A | A |
| 10 | Exemplary monomer 18 | — | 100/0 | A | A | A |
| 11 | Exemplary monomer 35 | — | 100/0 | A | C | C |
| 12 | Exemplary monomer 38 | — | 100/0 | A | A | A |
| 13 | Exemplary monomer 38 | Exemplary monomer 17 | 60/40 | A | A | C |
| 14 | Exemplary monomer 39 | Exemplary monomer 41 | 80/20 | A | C | C |
| 15 | Exemplary monomer 40 | Exemplary monomer 42 | 50/50 | A | A | C |

TABLE 3

| Example: | H/H running limit | Taber-volume loss | Photo-memory | Solvent cracking |
|---|---|---|---|---|
| 1 | Fog on 28,000th sheet | 1.5 mg | 35 V | A |
| 2 | Fog on 27,000th sheet | 1.4 mg | 35 V | A |
| 3 | Fog on 34,000th sheet | 1.6 mg | 30 V | A |
| 4 | Fog on 36,000th sheet | 1.5 mg | 30 V | A |
| 5 | Fog on 36,000th sheet | 1.4 mg | 35 V | A |
| 6 | Fog on 32,000th sheet | 1.5 mg | 35 V | A |
| 7 | Fog on 34,000th sheet | 1.3 mg | 30 V | A |
| 8 | Fog on 36,000th sheet | 1.6 mg | 35 V | A |

TABLE 3-continued

| Example: | H/H running limit | Taber-volume loss | Photo-memory | Solvent cracking |
|---|---|---|---|---|
| 9 | Fog on 35,000th sheet | 1.5 mg | 35 V | A |
| 10 | Fog on 37,000th sheet | 1.7 mg | 30 V | A |
| 11 | Fog on 26,000th sheet | 1.4 mg | 30 V | A |
| 12 | Fog on 36,000th sheet | 1.3 mg | 35 V | A |
| 13 | Fog on 31,000th sheet | 1.1 mg | 30 V | A |
| 14 | Fog on 27,000th sheet | 1.1 mg | 30 V | A |
| 15 | Fog on 33,000th sheet | 1.2 mg | 30 V | A |

TABLE 4

| | Charge-transporting material structure | Solubility (mg/g) | | |
|---|---|---|---|---|
| | | 25 mg | 50 mg | 100 mg |
| Example 16: | 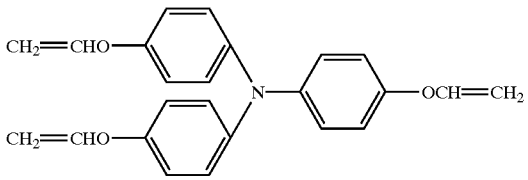 | A | A | A |

TABLE 4-continued

| | Charge-transporting material structure | Solubility (mg/g) 25 mg | 50 mg | 100 mg |
|---|---|---|---|---|
| Example 17: | 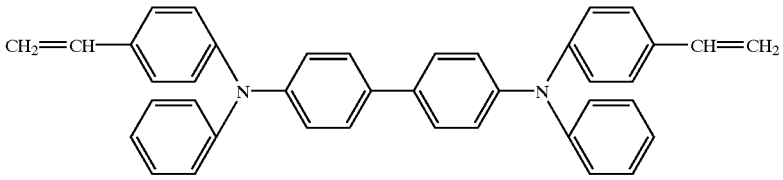 | A | A | C |
| Example 18: | 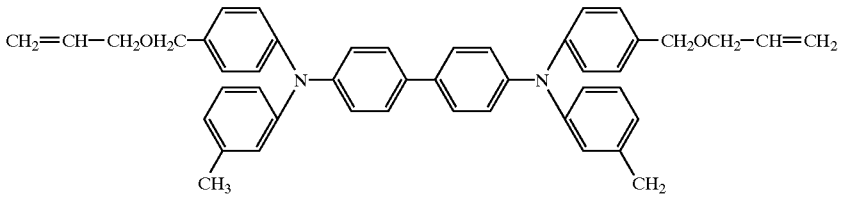 | A | A | A |
| Example 19: | 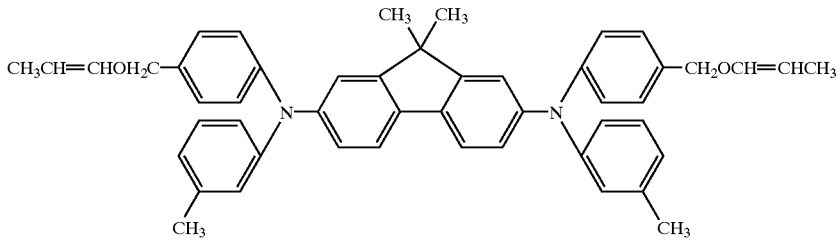 | A | C | C |
| Example 20: | 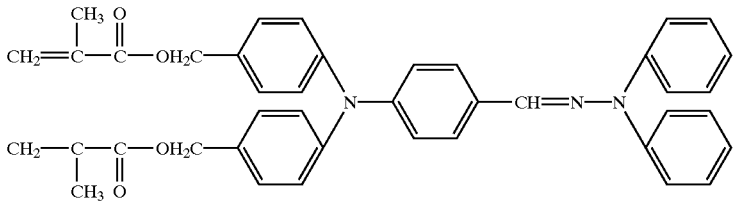 | A | A | A |
| Example 21: | 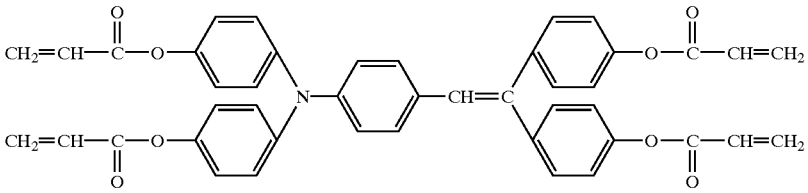 | A | A | A |

TABLE 5

| Example: | Monomer constitution: Constituent monomer 1 | Constituent monomer 2 | Blend ratio | Solubility (mg/g) 25 mg | 50 mg | 100 mg |
|---|---|---|---|---|---|---|
| 22 | Exemplary monomer 1 | Exemplary monomer 4 | 70/30 | C | C | C |
| 23 | Exemplary monomer 20 | — | 100/0 | A | A | C |
| 24 | Exemplary monomer 21 | Exemplary monomer 30 | 30/70 | A | A | A |
| 25 | Exemplary monomer 24 | Exemplary monomer 34 | 50/50 | A | A | C |
| 26 | Exemplary monomer 25 | Exemplary monomer 40 | 70/30 | A | A | A |
| 27 | Exemplary monomer 25 | Exemplary monomer 41 | 80/20 | A | A | C |

TABLE 6

| Example: | Monomer constitution: Constituent monomer 1 | Monomer constitution: Constituent monomer 2 | Blend ratio | Solubility (mg/g): 25 mg | 50 mg | 100 mg |
|---|---|---|---|---|---|---|
| 28 | Exemplary monomer 43 | Exemplary monomer 53 | 50/50 | A | C | C |
| 29 | Exemplary monomer 46 | Exemplary monomer 56 | 60/40 | A | A | C |
| 30 | Exemplary monomer 48 | — | 100/0 | A | A | C |
| 31 | Exemplary monomer 48 | Exemplary monomer 13 | 30/70 | A | A | A |
| 32 | Exemplary monomer 48 | Exemplary monomer 16 | 30/70 | A | A | C |
| 33 | Exemplary monomer 48 | Exemplary monomer 39 | 40/60 | A | A | A |

TABLE 7

| Example: | H/H running limit | Taber-volume loss | Photo-memory | Solvent cracking |
|---|---|---|---|---|
| 16 | Fog on 35,000th sheet | 1.1 mg | 30 V | A |
| 17 | Fog on 36,000th sheet | 1.0 mg | 35 V | A |
| 18 | Fog on 34,000th sheet | 1.2 mg | 30 V | A |
| 19 | Fog on 38,000th sheet | 0.9 mg | 35 V | A |
| 20 | Fog on 32,000th sheet | 1.4 mg | 35 V | A |
| 21 | Fog on 32,000th sheet | 1.0 mg | 35 V | A |
| 22 | Fog on 27,000th sheet | 1.1 mg | 30 V | A |
| 23 | Fog on 33,000th sheet | 1.1 mg | 35 V | A |
| 24 | Fog on 38,000th sheet | 0.8 mg | 35 V | A |

TABLE 7-continued

| Example: | H/H running limit | Taber-volume loss | Photo-memory | Solvent cracking |
|---|---|---|---|---|
| 25 | Fog on 34,000th sheet | 1.1 mg | 30 V | A |
| 26 | Fog on 34,000th sheet | 1.2 mg | 30 V | A |
| 27 | Fog on 35,000th sheet | 1.1 mg | 30 V | A |
| 28 | Fog on 26,000th sheet | 1.2 mg | 30 V | A |
| 29 | Fog on 33,000th sheet | 1.2 mg | 35 V | A |
| 30 | Fog on 34,000th sheet | 1.3 mg | 35 V | A |
| 31 | Fog on 35,000th sheet | 1.2 mg | 30 V | A |
| 32 | Fog on 35,000th sheet | 1.1 mg | 30 V | A |
| 33 | Fog on 34,000th sheet | 1.1 mg | 30 V | A |

TABLE 8

| Charge transport layer binder resin structure | | |
|---|---|---|
| Comparative Example 1: | 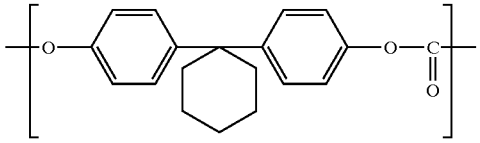 | Mw: 40,000 |
| Comparative Example 2: | 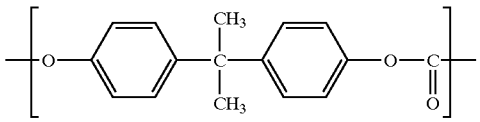 | Mw: 42,000 |

TABLE 9

| Monomer structure | |
|---|---|
| Comparative Example 3: | 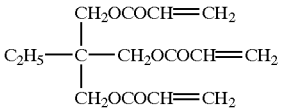 |

TABLE 9-continued

| | Monomer structure |
|---|---|
| Comparative Example 4: | 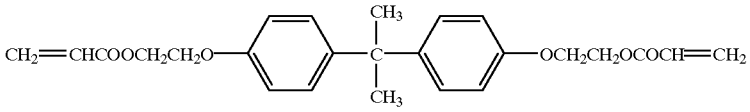 |
| Comparative Example 5: | 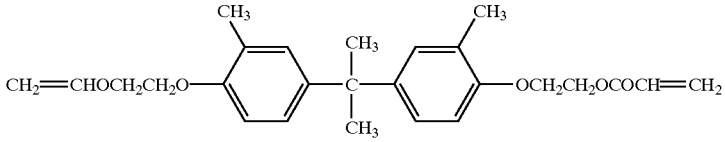 |

TABLE 10

| Comparative Example: | H/H running limit | Taber-volume loss | Photo-memory | Solvent cracking |
|---|---|---|---|---|
| 1 | Fog on 10,000th sheet | 2.8 mg | 85 V | C |
| 2 | Fog on 9,000th sheet | | | |
| | Scratch on 3,000th sheet | 3.2 mg | 80 V | C |
| 3 | Fog on 14,000th sheet | 4.5 mg | 105 V | A |
| 4 | Fog on 16,000th sheet | 3.7 mg | 100 V | A |
| 5 | Fog on 32,000th sheet | 3.6 mg | 50 V | A |
| | Scratch on 13,000th sheet | | | |

What is claimed is:

1. An electrophotographic photosensitive member comprising a conductive support and a photosensitive layer provided thereon;

wherein said photosensitive layer contains a copolymerization product of:

(A) a monomer having a reactive group represented by the following Formula:

$$—O—(—CH_2—)_n—CH{=}CH—R_0$$

wherein $R_0$ represents a hydrogen atom or a methyl group, and n represents 0 or 1, and having a fumarate structure; and (B) a charge-transporting material having a reactive group capable of reacting with the monomer.

2. An electrophotographic photosensitive member according to claim 1, wherein said charge-transporting material has a solubility S in said monomer of S ≧50 mg/g.

3. An electrophotographic photosensitive member according to claim 1, wherein said reactive group of the charge-transporting material has a structure selected from the group consisting of the following structures:

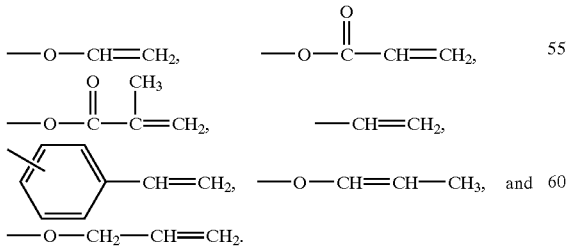

4. An electrophotographic photosensitive member according to claim 1, wherein said monomer has a molecular weight not more than 2,000.

5. A process cartridge comprising an electrophotographic photosensitive member and at least one means selected from the group consisting of a charging means, a developing means and a cleaning means, which are supported as one unit and are detachably mountable to the main body of an electrophotographic apparatus;

said electrophotographic photosensitive member comprising a conductive support and a photosensitive layer provided thereon;

wherein said photosensitive layer contains a copolymerization product of:

(A) a monomer having a reactive group represented by the following Formula:

$$—O—(—CH_2—)_n—CH{=}CH—R_0$$

wherein $R_0$ represents a hydrogen atom or a methyl group, and n represents 0 or 1, and having a fumarate structure; and (B) a charge-transporting material having a reactive group capable of reacting with the monomer.

6. A process cartridge according to claim 5, wherein said charging means is a contact charging means.

7. An electrophotographic apparatus comprising an electrophotographic photosensitive member, a charging means, an exposure means, a developing means, a cleaning means and a transfer means;

said electrophotographic photosensitive member comprising a conductive support and a photosensitive layer provided thereon;

wherein said photosensitive layer contains a copolymerization product of:

(A) a monomer having a reactive group represented by the following Formula:

$$—O—(—CH_2—)_n—CH{=}CH—R_0$$

wherein $R_0$ represents a hydrogen atom or a methyl group, and n represents 0 or 1, and having a fumarate structure; and (B) a charge-transporting material having a reactive group capable of reacting with the monomer.

8. An electrophotographic apparatus according to claim 7, wherein said charging means is a contact charging means.

9. An electrophotographic photosensitive member comprising a conductive support and a photosensitive layer provided thereon; wherein said photosensitive layer contains a polymerization product of a monomer having a reactive group represented by the following Formula (1):

$$—O(—CH_2—)_n—CH=CH—R_0 \quad (1)$$

wherein $R_0$ represents a hydrogen atom or a methyl group, and n represents 0 or 1, provided that $R_0$ represents a methyl group when n is 0; and said monomer has a fumarate structure.

10. An electrophotographic photosensitive member according to claim 9, wherein said monomer has a molecular weight not more than 2,000.

11. A process cartridge comprising an electrophotographic photosensitive member and at least one means selected from the group consisting of a charging means, a developing means, and a cleaning means, which are supported as one unit and are detachably mountable to the main body of an electrophotographic apparatus;

said electrophotographic photosensitive member comprising a conductive support and a photosensitive layer provided thereon; wherein said photosensitive layer contains a polymerization product of a monomer having a reactive group represented by the following Formula (1):

$$—O—(—CH_2—)_n—CH=CH—R_0 \quad (1):$$

wherein $R_0$ represents a hydrogen atom or a methyl group, and n represents 0 or 1, provided that $R_0$ represents a methyl group when n is 0; and said monomer has a fumarate structure.

12. A process cartridge according to claim 11, wherein said charging means is a contact charging means.

13. An electrophotographic apparatus comprising an electrophotographic photosensitive member, a charging means, an exposure means, a developing means, a cleaning means, and a transfer means;

said electrophotographic photosensitive member comprising a conductive support and a photosensitive layer provided thereon; wherein said photosensitive layer contains a polymerization product of a monomer having a reactive group represented by the following Formula (1):

$$—O—(—CH_2—)_n—CH=CH—R_0 \quad (1)$$

wherein $R_0$ represents a hydrogen atom or a methyl group, and n represents 0 or 1, provided that $R_0$ represents a methyl group when n is 0; and said monomer has a fumarate structure.

14. An electrophotographic apparatus according to claim 13, wherein said charging means is a contact charging means.

* * * * *

UNITED STATES PATENT AND TRADEMARK OFFICE

CERTIFICATE OF CORRECTION

PATENT NO. : 6,410,195 B1
DATED : June 25, 2002
INVENTOR(S) : Takakazu Tanaka et al.

It is certified that error appears in the above-identified patent and that said Letters Patent is hereby corrected as shown below:

Column l,
Line 34, "stability" should read -- stability, --.

Column 3,
Line 19, "in" should be deleted.
Line 19, "Scorotron" should be deleted.
Line 61, "O" should read -- 0 --.
Line 62, "O;" should read -- 0 --.

Column 4,
Line 9, "and provided thereon" should read -- upon which is provided --.
Line 48, "often" should read -- called --.

Column 5,
Line 14 "structures." should read -- structures --.
Lines 21-31 the following should be deleted:

--

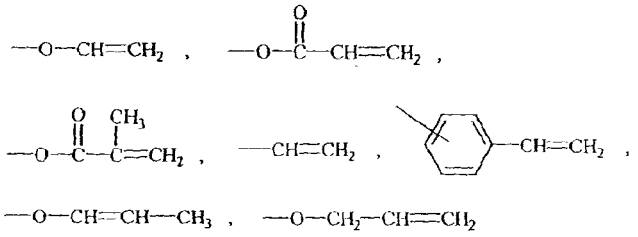

--.

Column 9,
Line 14, "array" should read -- array is carried out --.

Column 11,
Line 9, "dissolved" should read -- dissolve --.

Column 27,
Line 38, "Formula:" should read -- formula: --.

Column 28,
Lines 31 and 53, "Formula:" should read -- formula: --.

UNITED STATES PATENT AND TRADEMARK OFFICE

CERTIFICATE OF CORRECTION

PATENT NO. : 6,410,195 B1
DATED : June 25, 2002
INVENTOR(S) : Takakazu Tanaka et al.

It is certified that error appears in the above-identified patent and that said Letters Patent is hereby corrected as shown below:

Column 29,
Lines 3 and 25, "Formula (1):" should read -- formula (1): --.

Column 30,
Line 16, "Formula (1):" should read -- formula: --.
Line 17, "(1)" should be deleted.

Signed and Sealed this

Twenty-fifth Day of February, 2003

JAMES E. ROGAN
*Director of the United States Patent and Trademark Office*